US008459333B2

(12) United States Patent
Kurz et al.

(10) Patent No.: US 8,459,333 B2
(45) Date of Patent: Jun. 11, 2013

(54) METHOD FOR PRODUCING ROLLING STOCK ROLLED IN A ROLLING TRAIN OF A ROLLING MILL, CONTROL AND/OR REGULATION DEVICE FOR ROLLING MILL FOR PRODUCING ROLLED ROLLING STOCK, ROLLING MILL FOR PRODUCING ROLLED ROLLING STOCK, MACHINE READABLE PROGRAM CODE AND STORAGE MEDIUM

(75) Inventors: Matthias Kurz, Erlangen (DE); Hans-Ulrich Löffler, Erlangen (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 13/318,829

(22) PCT Filed: Apr. 14, 2010

(86) PCT No.: PCT/EP2010/054884

§ 371 (c)(1),
(2), (4) Date: Nov. 4, 2011

(87) PCT Pub. No.: WO2010/127929

PCT Pub. Date: Nov. 11, 2010

(65) Prior Publication Data

US 2012/0043043 A1 Feb. 23, 2012

(30) Foreign Application Priority Data

May 6, 2009 (EP) ..... 09159518

(51) Int. Cl.

| | |
|---|---|
| ***B22D 11/12*** | (2006.01) |
| ***B22D 11/16*** | (2006.01) |
| ***B21B 1/46*** | (2006.01) |
| ***B21B 37/00*** | (2006.01) |

(52) U.S. Cl.
USPC ..... 164/451; 164/476; 164/417; 29/527.7; 29/33 C; 72/6.2; 72/234

(58) Field of Classification Search
USPC ..... 164/451, 476, 477, 413, 417; 29/527.7, 29/33 C; 72/6.2, 8.9, 12.3, 12.4, 234
See application file for complete search history.

(56) References Cited

U.S. PATENT DOCUMENTS

| | | | | |
|---|---|---|---|---|
| 5,634,257 | A | 6/1997 | Kajiwara et al. | 29/527.7 |
| 6,202,459 | B1 * | 3/2001 | Palzer et al. | 72/8.9 |

(Continued)

FOREIGN PATENT DOCUMENTS

| | | | |
|---|---|---|---|
| DE | 19518144 | A1 | 11/1995 |
| WO | 2007/073841 | A1 | 7/2007 |
| WO | 2007/101308 | A1 | 9/2007 |

OTHER PUBLICATIONS

European Search Report, European application No. 09159518.1-2302, 4 pages, Nov. 25, 2009.

(Continued)

*Primary Examiner* — Kevin P Kerns
(74) *Attorney, Agent, or Firm* — King & Spalding L.L.P.

(57) ABSTRACT

A rolling mill for producing rolled rolling stock is operated in a continuous manner by integrally forming the rolling stock during scheduled operation from a supply device which supplies the stock to the rolling mill to one finishing rolling train arranged downstream of the rolling stock supply device by guiding the stock into the finishing rolling train continuously and rolling it to form a first outflow product. The operation is monitored for a deviation from the scheduled operation that influences the rolling process, wherein in case of a deviation measures are taken to examine whether a second outflow product, which is different from the first outflow product, can still be produced. If the second outflow product cannot be produced, the operation of the rolling mill is altered from a continuous operation to a discontinuous operation, whereby production failures caused by undesired process deviations in a rolling mill can be reduced.

13 Claims, 3 Drawing Sheets

U.S. PATENT DOCUMENTS

| | | | | |
|---|---|---|---|---|
| 6,240,756 | B1 | 6/2001 | Tsugeno | 72/8.1 |
| 7,849,722 | B2 | 12/2010 | Britanik et al. | 72/9.2 |
| 2008/0060403 | A1* | 3/2008 | Felkl et al. | 72/12.3 |
| 2009/0044587 | A1* | 2/2009 | Jepsen et al. | 72/234 |
| 2010/0212856 | A1 | 8/2010 | Rosenthal et al. | 164/493 |

OTHER PUBLICATIONS

International PCT Search Report and Written Opinion, PCT/EP2010/054884, 12 pages, Mailed Aug. 4, 2010.

* cited by examiner

METHOD FOR PRODUCING ROLLING STOCK ROLLED IN A ROLLING TRAIN OF A ROLLING MILL, CONTROL AND/OR REGULATION DEVICE FOR ROLLING MILL FOR PRODUCING ROLLED ROLLING STOCK, ROLLING MILL FOR PRODUCING ROLLED ROLLING STOCK, MACHINE READABLE PROGRAM CODE AND STORAGE MEDIUM

CROSS-REFERENCE TO RELATED APPLICATIONS

This application is a U.S. National Stage Application of International Application No. PCT/EP2010/054884 filed Apr. 14, 2010, which designates the United States of America, and claims priority to EP Application No. 09159518.1 filed May 6, 2009. The contents of which are hereby incorporated by reference in their entirety.

TECHNICAL FIELD

The invention relates to a method for producing rolling stock rolled in a rolling train of a rolling mill. The invention further relates to a control and/or regulation device for a rolling mill for producing rolled rolling stock. The invention additionally relates to a rolling mill for producing rolled rolling stock. The invention further relates to machine-readable program code and to a storage medium with machine-readable program code.

BACKGROUND

In the manufacturing of semi-finished products, especially metal strips in the metalworking industry, production is planned to fully utilize the corresponding plants for manufacturing a corresponding product. For manufacturing the corresponding product a corresponding process schedule is prepared, through which the product entering the mill is converted into a desired outflow product leaving the mill.

A schedule of the rolling process for a specific product is also determined in rolling mills for manufacturing metal strips. Such a process schedule relating to a roll stand or a number of roll stands, especially a rolling train, is referred to as a pass schedule. In this case a single passage of the stock to be rolled through a rolling stand is viewed as a pass. As a rule a plurality of products, which are dependent on the mode of operation of the rolling mill, are manufactured by a rolling mill.

If the process is disrupted during the processing of stock to be rolled in a rolling mill, this results in a deviation from the conditions present in the rolling mill for rolling the stock and from the conditions required for the pass schedule for rolling the stock. As a result of this deviation it can occur that a specific product can no longer be produced in accordance with its pass schedule because of an undesired process deviation.

Under these circumstances it may be necessary to stop the entire rolling mill in order to remove from the rolling mill stock that can no longer be processed. Otherwise scrap is produced since the quality parameters of the product can no longer be adhered to. This leads to production outages and possibly even to damage to the rolling mill.

SUMMARY

According to various embodiments, production outages in rolling mills, especially casting rolling mills, caused by undesired process deviations, which affect the manufacturing of an outflow product can be reduced.

According to an embodiment, in a method for manufacturing rolling stock rolled in a rolling train of a rolling mill, especially a casting rolling mill, the rolling mill is operated continuously, with the rolling stock being embodied during the planned operation in one piece from a device feeding the rolling stock to the rolling mill, especially a casting device and/or a rolling stock winding device at least up to a finishing rolling train arranged downstream from the rolling stock feed device in the mass flow direction, with the rolling stock entering the finishing rolling train continuously and being rolled in the finishing rolling train continuously into a first outflow product, whereby the operation of the rolling mill is monitored for occurrence of a deviation from the planned operation of the rolling mill influencing the rolling process, whereby upon occurrence of the deviation, a check is made as to whether, in the light of the deviation, a second outflow product differing from the first is able to be manufactured in continuous operation, whereby for non-manufacturability of the second outflow product the operation of the rolling mill is changed from continuous operation of the rolling mill into discontinuous operation.

According to a further embodiment, if the second outflow product is able to be manufactured, a choice can be made as to whether the second outflow product will be manufactured or the operation of the rolling mill is changed to discontinuous operation. According to a further embodiment, if the second outflow product is able to be manufactured the second outflow product will be manufactured in continuous operation of the rolling mill. According to a further embodiment, a check can be made as to whether, in discontinuous operation the first outflow product and/or a further second outflow product is able to be manufactured. According to a further embodiment, the change to discontinuous operation can be made by separation, especially cutting, of the rolling stock between the rolling stock feed device, especially the casting device or the rolling stock winding device and the finishing rolling train. According to a further embodiment, on changing operation into discontinuous operation at least for a short time a speed of the rolling stock can be reduced by means of the rolling stock feed device, especially a casting speed of the casting device or a winding speed of a rolling stock winding device and/or a rolling speed of the finishing rolling train is increased. According to a further embodiment, for increasing a distance between the rolling stock entering the finishing rolling train one after the other, the rolling stock can be cut at least twice between the rolling stock feed device, especially the casting device or the rolling stock winding device, and the finishing rolling train, whereby a part of the rolling stock delimited by the first and the second cut is removed from the rolling process. According to a further embodiment, if the second outflow product is not able to be manufactured, the operation of the rolling mill can be changed from continuous operation of the rolling mill into discontinuous operation during the rolling of rolling stock.

According to another embodiment, a control and/or regulation device for a rolling mill for manufacturing rolled rolling stock with a machine-readable program code which has control commands which, when executed, cause the control and/or regulation device to carry out the method as described above.

According to yet another embodiment. A rolling mill, especially a combined casting and rolling mill, for manufacturing rolled rolling stock with a device for feeding rolling stock into the rolling mill, especially a casting device for continuous casting of rolling stock or a rolling stock winding device, may comprise a finishing rolling train for rolling stock to be rolled with a separation device arranged in the mass flow direction between rolling stock feed device and finishing rolling train for cutting rolling stock, with a control and/or regulation device as described above, whereby the finishing rolling train the rolling stock feed device and the separation device are actively connected to the control and/or regulation device.

According to yet another embodiment, a machine-readable program code for a control and/or regulation device for a rolling mill may include control commands which cause the control and/or regulation device to carry out the method as described above.

According to yet another embodiment, a storage medium may comprise a machine-readable program code as described above.

BRIEF DESCRIPTION OF THE DRAWINGS

Further advantages emerge from an exemplary embodiment which is explained in greater detail below and refers to the figures shown as schematic diagrams, in which.

DETAILED DESCRIPTION

Figure 1:
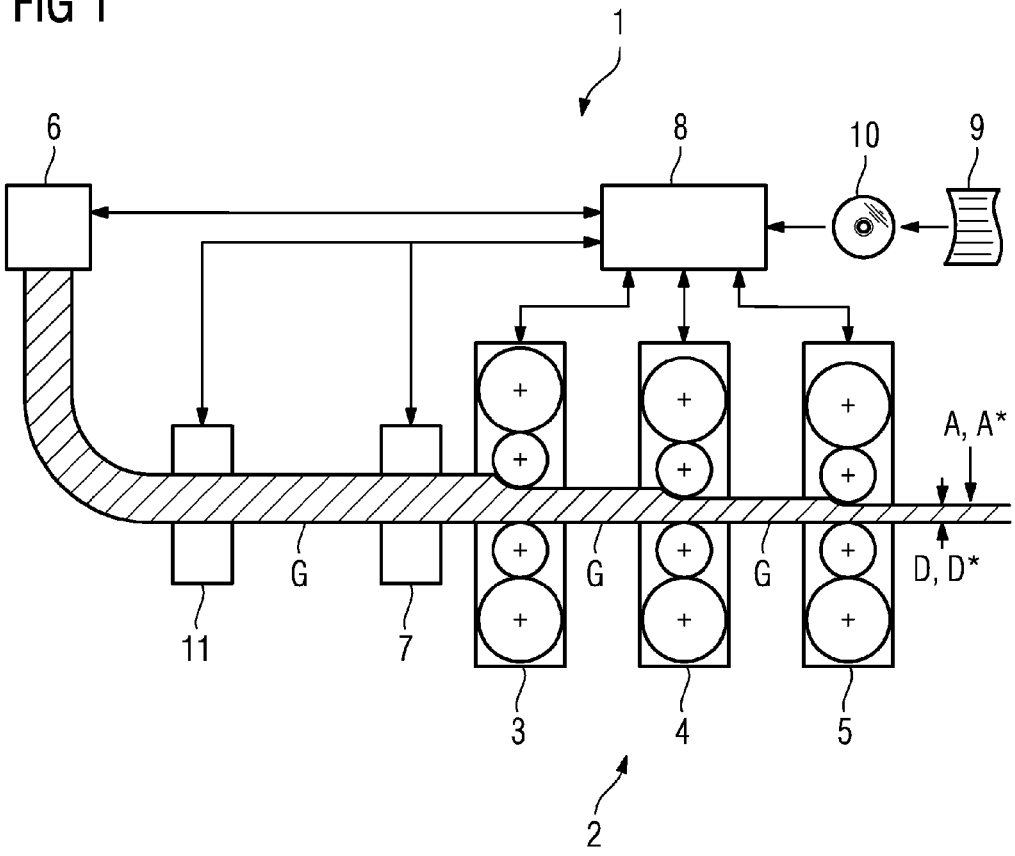
FIG. 1 shows a schematic diagram of a casting rolling mill embodied to carry out a form of embodiment of the method.

According to various embodiments, in a method for manufacturing rolled rolling stock rolled in a rolling train of a rolling mill, especially a casting rolling mill, the rolling mill is continuously operated by the rolling stock, during operation according to plan, being embodied in one piece from a device feeding the rolling stock to the rolling mill, especially a casting device and/or a rolling stock winding device, to at least one rolling train downstream from the rolling stock feed device in the mass flow direction, by the rolling stock entering continuously into the finishing rolling train and being rolled continuously in the finishing rolling train into an outflow product. In this case the operation of the rolling mill is monitored for an occurrence of a deviation causing the rolling process from the planned operation of the rolling mill, with a check being made, on occurrence of the deviation, whether in the light of the deviation a second outflow product differing from the first outflow product is still able to be manufactured. If the second outflow product cannot be manufactured the operation of the rolling mill is changed from continuous operation into discontinuous operation.

The rolling stock feed device is used to introduce stock for rolling into the rolling mill. This can for example be a casting device in combined casting and rolling mills. This can however for example also be a rolling stock winding device especially a stock unwinding device, which supplies the rolling mill by winding unwound rolling stock into rolling stock to be processed, especially hot-rolled strip. This can especially be embodied as a coiler or a coil box for hot-rolled strip. In particular a plurality of rolling stock winding devices for feeding rolling stock into the rolling mill can be provided. Preferably the rolling stock feed device is embodied so that rolling stock is able to be introduced continuously by means of said device into the rolling mill.

By changing the operating mode of the rolling mill from a continuous operation into a discontinuous operation, also known as batch mode, the operation of the rolling mill is made more flexible, since the units of the rolling mill are decoupled from one another. This makes possible rolling of pass schedules which are not able to be rolled in continuous operation from a technological standpoint. Thus it is possible to maintain a rolling operation, although neither the first outflow product nor an alternate outflow product is able to be manufactured in continuous operation of the rolling mill.

A deviation is to be understood as a process deviation through which the first, originally manufactured or desired outflow product is no longer able to be manufactured. The deviation can be predictable or can occur unexpectedly.

The criterion of non-manufacturability includes both a "hard" i.e. technical non-manufacturability, i.e. an outflow product is technically simply not able to be manufactured under the predetermined peripheral conditions, and also a "soft" non-manufacturability, i.e. an outflow product is actually technically able to be manufactured but the operator does not want to do this for commercial reasons, for example since the technically-manufacturable outflow product has a lower production priority for example and thus may be stored for a long period, which is not desirable for logistical or financial reasons. In respect of the technical manufacturability checks are preferably also made whether a desired flatness and a desired profile can be set for the current deviation, so that the target corridor for flatness and profile is achieved.

In an embodiment, if the second outflow product is able to be manufactured said outflow product is manufactured. This process is preferably automated. To do this a pass schedule is calculated under the changed peripheral conditions, in some cases caused by the process deviations. If a pass schedule or an alternate outflow product can be determined which is still able to be processed in the light of the deviation, this pass schedule or the alternate outflow product is produced in continuous operation. This enables continuous operation of the rolling mill to be maintained.

In a further embodiment, if the second outflow product is able to be manufactured, a choice is made as to whether the second outflow product will be manufactured or operation of the rolling mill changed to discontinuous operation. This is especially expedient if only outflow products not required by customers are still able to be manufactured or only products with very low production priority are still able to be manufactured. In such cases it can be expedient, despite the ability to manufacture an alternate outflow product, to change to discontinuous operation of the rolling mill in order to manufacture the first outflow product or a higher second outflow product with higher production priority than the outflow products able to be manufactured in continuous operation. The decision as to whether, with the availability of the second manufacturable outflow product, the change is to be made to discontinuous operation can be made manually or can be automated.

In a further embodiment, a check is preferably made before the transition from continuous operation into discontinuous operation as to whether in discontinuous operation the first or a further second outflow product is able to be manufactured. The further second outflow product can be identical or different from the second outflow product determined for continuous operation. Such checking makes it possible, especially before changing operation, to define which outflow product is to be manufactured in discontinuous operation. For example the first outflow product which was manufactured in continuous operation, although, as a result of the deviation, it may no longer be able to be manufactured in continuous operation, can still be manufactured in discontinuous operation. This allows an optimum possible production strategy to be realized, since especially high-priority outflow products, which were typically manufactured in continuous operation, can also continue to be manufactured by switching the mode of operation. This might allow a customer order to still be fully processed although this would no longer have been possible in continuous operation.

In a further embodiment the change to discontinuous operation is made by separating, especially cutting, the rolling stock between the rolling stock feed device, especially the casting device or the rolling stock winding device, and the finishing rolling train. Cutting the rolling stock in the mass flow direction behind a high reduction mill or a preliminary train, provided the rolling mill includes this, is especially advantageous. The cutting can be undertaken with normal tools, especially in a mechanical or thermal manner.

In a further embodiment, on change of operation into discontinuous operation, at least for a short period, a rolling stock feed speed of the rolling stock passing through the rolling stock feed device, especially a casting speed of the casting device or a winding speed of the rolling stock winding device, is reduced and/or a rolling speed of the finishing rolling train is increased. This increases the distance between items of rolling stock following on from each other, which allows a more flexible handling of the individual rolling stock to be undertaken. For example during the separation, especially cutting, the casting speed can be reduced by comparison with the casting speed in continuous operation. Advantageously at least the inflow speed into the rolling train, especially the finishing rolling train, is increased. This means that after the ending of the cutting process the part of the rolling stock facing towards the finishing rolling train is accelerated away from the separation device in the direction of the finishing rolling train, whereby a gap arises between the rolling stock entering the rolling train and the rolling stock disposed before it in the mass flow direction of the separation device. This means that the rolling stock located in the finishing rolling train can be handled more flexibly since the coupling of the units is deactivated by the cutting process.

In a further embodiment, to increase a distance between items of rolling stock entering the finishing rolling train one after the other, the rolling stock is cut at least twice between rolling stock feed device, especially casting device or rolling stock winding device, and finishing rolling train, with the part of the rolling stock delimited by the first and second cut being removed from the rolling process. This results in the gap between the rolling stock parts separated from one another by cutting becoming even greater, in that a part of the rolling stock has been separated out from the original strip. This makes the rolling of an outflow product even more flexible. This separated-out part comprising rolling stock can be stored if necessary or forms scrap. The latter is acceptable to the extent that, if the distance between the rolling stock might not be sufficient, the entire rolling stock in the mill would constitute scrap since it may be that no outflow product can be produced.

According to further embodiments, a control and/or regulation device for a rolling mill for manufacturing rolled rolling stock, comprises a machine readable program code having control commands which, when executed, cause the control and/or regulation device to carry out the method as described above.

According to yet further embodiments, a rolling mill, especially a casting rolling mill for manufacturing rolled rolling stock, may comprise a device for feeding in rolling stock into the rolling mill, especially with a casting device for continuous casting of rolling stock or with a rolling stock winding device for unwinding wound rolling stock, with a finishing rolling train for rolling stock to be rolled with a separation device arranged in the mass flow direction between rolling stock feed device and finishing rolling train for separating rolling stock, with a control and/or regulation device as described above, whereby the finishing rolling train, the rolling stock feed device and the separation device are actively connected to the control and/or regulation device.

According to yet further embodiments, a machine-readable program code for a control and/or regulation device for a rolling mill, may comprise the program code having control commands which cause the control and/or regulation device to carry out the method as described above.

In addition, according to various further embodiments, a storage medium may comprise a machine-readable program code stored thereon, as described above.

The rolling mill 1 shown in FIG. 1 is embodied as a combined casting and rolling mill and comprises a casting device 6 with which metal, referred to below as the rolling stock G, is cast, which subsequently undergoes a rolling process.

In the present example the rolling process is shown on the basis of a three-stand rolling train 2 which schematically represents a finishing rolling train 2.

The casting device 6 can be embodied for example as a coquille. The casting device 6 can likewise be embodied as a rolling casting machine. There are no restrictions as regards the casting devices able to be used.

In planned operation the rolling mill 1 is operated in what is referred to as endless operation, i.e. metal is continuously cast and fed directly to a rolling process, especially a finishing rolling process. The rolling stock thus extends in planned operation right from the casting device 6 to the finishing rolling train 2.

A rolling stock section G emerging from the casting device 6 passes through the rolling mill 1. In this case this rolling stock section G can first pass through units such as an oven, a segment cooling device, a descaling device and/or a preliminary train, especially a high reduction mill 11, before the rolling stock section G enters into the finishing rolling train 2.

Subsequently the rolling stock section G passes through the finishing rolling train 2 as well as possibly further units arranged downstream of the finishing rolling train 2 in the mass flow direction, such as a cooling line and/or a coiler, by means of which the rolling stock G is coiled up.

The finishing rolling train 2, in the rolling mill 1 shown, comprises three rolling stands 3 or 4 or 5 respectively, which symbolically represent the rolling stands of a finishing rolling train. A finishing rolling train as a rule comprises more than three rolling stands, especially four, five or six rolling stands.

Each rolling stand 3, 4 or 5 comprises a pair of working rollers and a pair of support rollers in each case, which are not shown in greater detail in the figure. The properties of the rolling stands of the finishing rolling train 2 individually do not have any significant role to play in the performance of various embodiments.

After the last rolling stand 5 an outflow product A with the thickness D emerges from the last rolling stand 5 of the finishing rolling train 2. This is the planned, first outflow product A.

This is further processed as a rule after emerging from the finishing rolling train 2, for example within the context of a unit disposed downstream of the finishing rolling train 2 in the mass flow direction. As explained above, such a unit can for example be a cooling line, by means of which a desired phase or jointing status of the rolling stock is set and/or a coiler for coiling up the strip and/or other units.

In accordance with the exemplary embodiment all units of the rolling mill 1 which can influence a mass flow stream in the rolling mill 1, especially through the finishing rolling train 2, are actively connected by means of a control and/or regulation device 8. The control and/or regulation device 8 monitors the operation of the rolling mill 1 according to plan, especially the operation according to plan of the finishing rolling train 2, in accordance with a first pass schedule for manufacturing a first outflow product A with the thickness D.

Expected or also unexpected deviations from the planned operation of the rolling mill 1 can occur during the manufacturing of this outflow product A.

An expected deviation from operation according to plan can be the idling of the casting device 6 because the liquid metal supply cannot be maintained for example. Such a process is predictable as a rule. The operating personnel know when this state will occur. However there must be a reaction to this generally undesired process deviation.

Unpredictable deviations from operation according to plan for manufacturing a first outflow product A according to a first pass schedule can be caused for example by a short-term required increase or decrease of the casting speed of the casting device 6, by a malfunction of the unit, of an oven and/or a cooling device for example, especially a segment cooling device, which is or are arranged upstream of the finishing rolling train 2 in the mass flow direction, or by technical problems during coiling up the strip on the coiler which is disposed downstream of the finishing rolling train 2. Such deviations require an instantaneous reaction to the deviation since for example in the case of mass flow changes, e.g. through a short-term casting flow speed change, the mass flow downstream and/or upstream differs relative to the mass flow through the finishing rolling train 2. This leads to significant problems in the rolling mill 1. In particular formation of a wave or a crack in the rolling stock G can occur.

Furthermore such a deviation can also be caused by other influences which are not caused directly by a change in the mass flow through the rolling mill 1. An example of this is e.g. a desired deviation in the rolling stock temperature at a specific point before the rolling train, such as on entry into the finishing rolling train 2. This can lead to the outflow product A with the thickness D no longer being able to be rolled since the material on entry is too hard for it to be rolled to the desired final thickness, as a result of the temperature being too low. There must be a fast reaction in order to avoid incorrect processing or even damage to the mill.

The disadvantageous effects of such process deviations can be reduced by means of the method or established means according to various embodiments.

Such a method is preferably implemented in the form of a machine readable program code 9. The program code can be stored as programmable logic by a storage medium 10, for example a CD or another data carrier, on the control and/or regulation device 8. The control and/or regulation device 8 is thus embodied to instigate at least one form of embodiment of the method as a reaction to a process deviation detected by the control and/or regulation device 8.

If such a process deviation is detected by the control and/or regulation device 8, i.e. that an outflow product A manufactured in continuous operation of the rolling mill 1 according to plan is no longer able to be manufactured during the process deviation, an attempt is then made by the control and/or regulation device 8 to determine an alternate outflow product A* with an outflow thickness D*, which is still able to be manufactured in continuous operation during the current process disruption.

If an alternate outflow product A* is technically able to be manufactured in continuous operation of the rolling mill 1 and if it is also sensible to manufacture this alternate outflow product A* at the corresponding time, the finishing rolling train 2 is switched over during the rolling of the outflow product A to a new pass schedule assigned to the alternate outflow product A*. This pass schedule is determined by means of known methods, e.g. shown in DE 44 21 005 B4 or DE 37 21 744 A1.

The extent to which the production of the alternate outflow product A* is sensible despite being technically feasible can be left to the operator since the latter generally knows how to operate its rolling mill 1 cost effectively. To this end the operator or the operating personnel can be provided with a selection facility, preferably in the control room.

If no alternate outflow product can be determined within a predetermined time that is able to be manufactured during the current process deviation in continuous operation of the rolling mill 1 for technical or economic reasons and/or if only outflow products can be determined of which the production is not expedient at this point in time for economic reasons for example, the operation of the rolling mill 1 can then be changed from continuous operation into discontinuous operation. An increased flexibility in the process sequence of the rolling mill 1 is obtained in this way since the current coupling of the units of the rolling mill is canceled by the rolling stock G.

To move from continuous operation into discontinuous operation of the rolling mill, the control and/or regulation unit 8 controls a separation device 7, for example flying shears, which is arranged between finishing rolling train 2 and casting device 6, preferably after a high reduction mill 11 and which continuously separates rolling stock G embodied between casting device 6 and finishing rolling train 2. If a preliminary train, in the form of a high reduction mill 11 for example, is disposed upstream of the finishing rolling train 2 in the mass flow direction, a separation of the rolling stock can advantageously be undertaken between finishing rolling train 2 and high reduction mill, since here the rolling stock already has a correspondingly small thickness.

The shears 7 separate the rolling stock G at right angles to the mass flow direction of the rolling mill 1. Preferably after completion of the separation process or cutting, the rolling speed of the finishing rolling train 2 is increased at least for a short time so that the separated, finishing rolling train-side part of the rolling stock G is accelerated away in the mass flow direction from the separation device 7. If necessary the casting speed of the casting device 6 is reduced at least for a short time advantageously shortly before or at the beginning of the separation. The reduction of the casting speed simplifies the cutting of the rolling stock G and after the end of the cutting a gap which is as large as possible is created between the separated part of the rolling stock G and the part of the rolling stock G still disposed upstream of the separation device 7 in the mass flow direction. However the throughput of the mill is reduced by the slower casting. In addition regulation of a casting device is comparatively slow as a rule. For this reason an attempt should be made to only create an appropriate gap with the aid of the rolling speed. The greater the distance between two separate items of rolling stock on entry into the finishing rolling train 2, the more flexible the operation of the finishing rolling train 2 can be made. The more flexibly the operation of the finishing rolling train 2 can be designed, the more possible outflow products can basically be realized. In particular it is advantageous to set the rolling speed of the finishing rolling train significantly higher than the casting speed of the casting device or the outflow speed of the rolling stock from any high reduction mill which may be present.

For this reason even further measures can be taken if necessary to enlarge or to increase the gap or the distance between two items of rolling stock entering the finishing rolling train 2 one after the other.

Thus the rolling stock G, with suitable adjustment of the rolling speed of the finishing rolling train and casting speed, can be cut twice in a short time, with the piece of rolling stock then separated by the cuts being taken out of the process. By such a method the gap between two items of rolling stock entering the finishing rolling train one after the other can be further increased. The time gap between the at least two cuts is dependent on the size of the gap which is to be created.

This piece which is delimited by at least two cuts, can be cut so that it has the dimensions of a slab and can be further processed at a later time in the rolling mill 1. By taking this piece out of ongoing operation of the rolling mill 1 it can be stored in a store and if necessary introduced back into the rolling mill 1 or into the rolling process. This results in no scrap being produced. Despite this the operation of the finishing rolling train is made more flexible by creating a sufficiently large gap between two items of rolling stock entering the finishing rolling train one after the other.

Appropriate shears can be used for example as the separation device 7, e.g. a flying shear by means of which a strip is cut. Drum shears can also be used however, which for example cut off a predetermined section of the rolling stock in order to increase a gap to the rolling stock preceding it in time. A laser cutting device or similar can also be used if necessary as the separation device 7.

Figure 2:
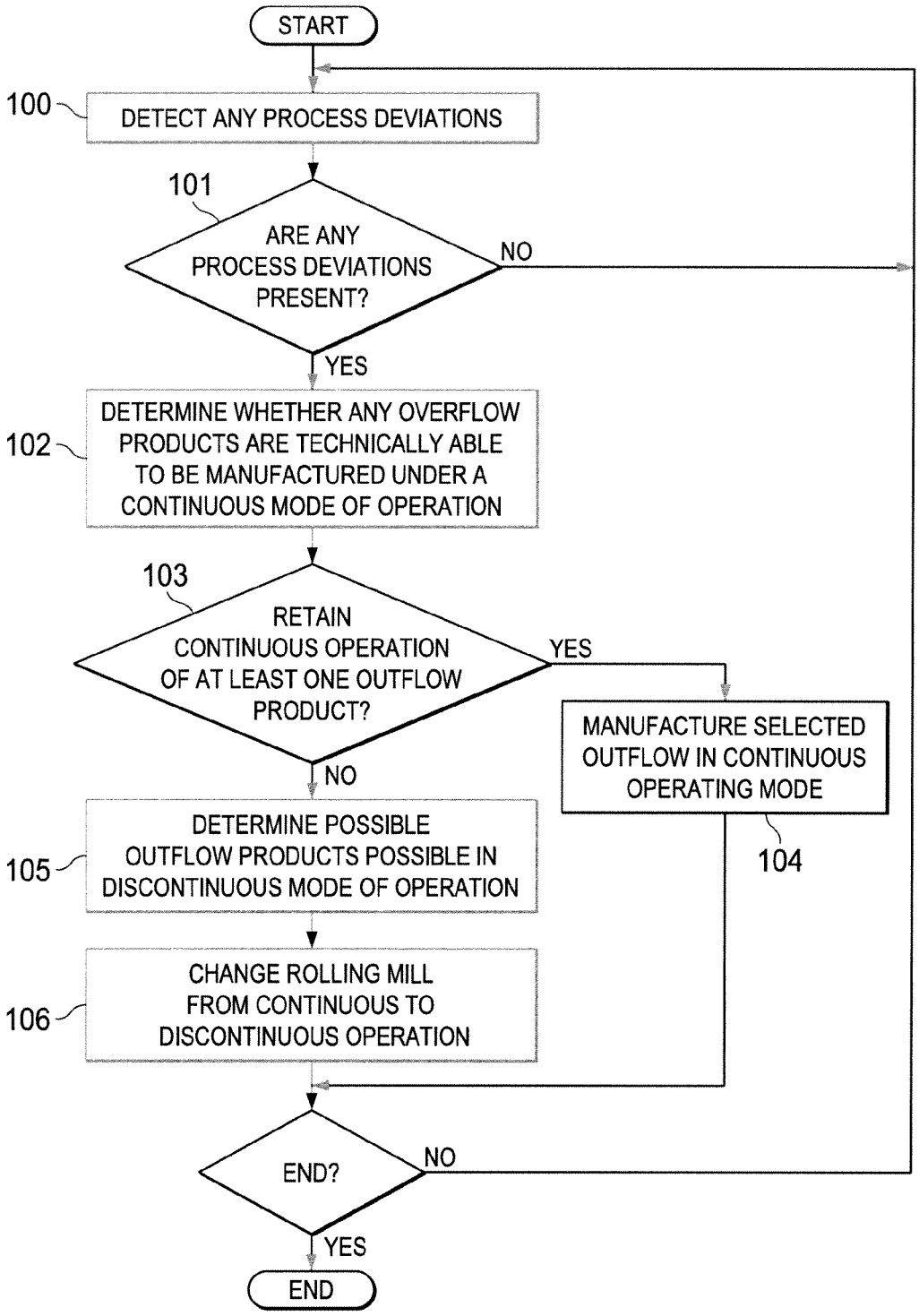
FIG. 2 shows a flow diagram for a typical execution of a sequence of the method.

FIG. 2 shows a schematic flow diagram for an embodiment of the method. The flow diagram is based on the fact that the rolling mill 1 is operated in continuous planned operation. The rolling stock is thus embodied from the rolling stock feed device up to the finishing rolling train in a single part or in one piece.

During the operation according to plan a permanent check is made as to whether there are process deviations present which lead to the first outflow product no longer being able to be manufactured. To this end the control and/or regulation device is supplied with appropriate information by the individual units and if necessary by further sensors detecting the process and/or the state of the rolling mill and the information is evaluated by this device. This occurs in a method step 100.

If in a method step 101 it is established that no process deviation is present, the monitoring of the operation of the rolling mill is continued.

If it is established in a method step 101 that a corresponding deviation is present, so that the first outflow product is no longer able to be manufactured, then an alternate outflow product which is still able to be manufactured with the current process deviation is first sought by means of the control and/or regulation device. This occurs in a method step 102. In this step it is determined whether and which outflow products are technically able to be manufactured under a continuous mode of operation of the rolling mill.

If the result of the determination from method step 102 is at least one outflow product technically able to be manufactured in continuous operation, the operating personnel in the control room can then choose whether to produce this technically possible outflow product or one of these technically possible outflow products in continuous operation or whether preferably a switch is to be made to discontinuous operation of the rolling mill.

Preferably not only outflow products able to be manufactured in continuous operation are determined in method step 102 but also the outflow products able to be manufactured with the current deviation in discontinuous operation. This is preferably displayed separately to the operating personnel for continuous and discontinuous operating mode.

If the at least one outflow product is technically able to be manufactured in continuous operation, the operating personnel preferably have the choice of whether to retain continuous operation of the rolling mill or whether they wish to change operation to discontinuous operation. This selection step is reproduced by method step 103.

If the alternate outflow product or one of the alternate outflow products is to be manufactured in continuous operation, this is selected accordingly and the selected outflow product is manufactured in a method step 104. For this the operation of the finishing rolling train is switched from operation in accordance with the first pass schedule that corresponds to the original first outflow product to operation in accordance with a pass schedule that corresponds to the alternate second outflow product. This switchover is undertaken in ongoing operation of the rolling mill, i.e. during the rolling of the rolling stock.

If no alternate outflow product is technically able to be manufactured with the current deviation in continuous operation, the operation of the rolling mill is to be transferred from continuous operation to discontinuous operation in order to avoid scrap. In this case in the method step 103 there is an automatic branch in the direction of a change to discontinuous operation.

In this case the outflow products that are possible in discontinuous operation of the rolling mill are determined in a method step 105. The outflow product for discontinuous operation is selected automatically or manually.

Subsequently the operation of the rolling mill is changed from continuous to discontinuous operation so that the selected outflow product is manufactured. This occurs in a method step 106. The change is made in accordance with the information given above for FIG. 1.

If the process deviation is rectified at a later time, a switch can if necessary be made back into continuous operation of the rolling mill, whereby if necessary the same or another alternate outflow product is manufactured in continuous operation.

The retention of the outflow product—provided this outflow product is technically able to be manufactured in continuous operation—on transition from a discontinuous mode into a continuous mode has the advantage that the system throughput is increased for the same outflow product.

If necessary the system can also continue to work in discontinuous operation, whereby different outflow products are manufactured which might not be able to be manufactured in continuous operation under the given peripheral conditions.

Figure 3:
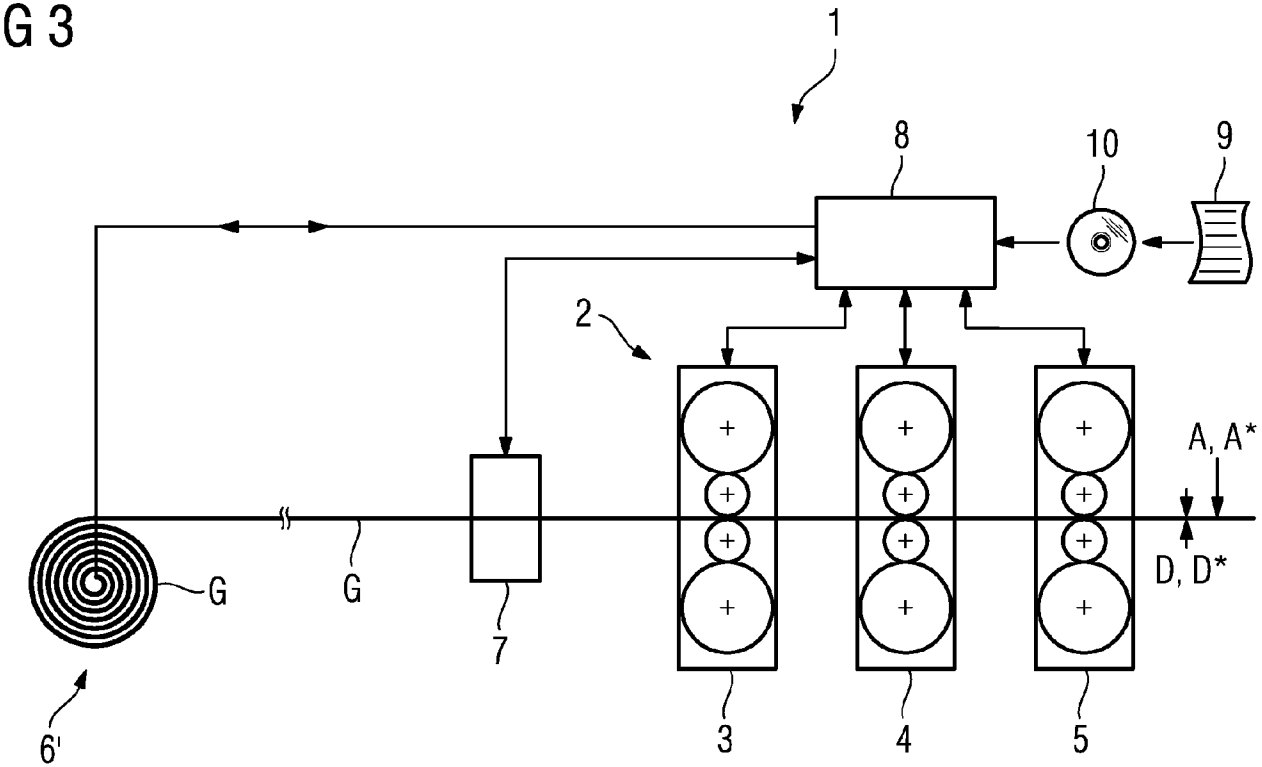
FIG. 3 shows a schematic rolling mill with a rolling mill unwinding device for feeding in rolling stock.

The rolling mill 1 shown in FIG. 3 has a rolling stock winding device 6' as its rolling stock feed device. The wound rolling stock G, especially hot strip, is unwound from this. The rolling stock is thus fed into the rolling mill quasi-continuously. If the number of rolling stock winding devices are used for feeding rolling stock G into the rolling mill 1 endless operation is also possible, which can be achieved by the strips of different rolling stock winding devices being connected to one another, e.g. by welding.

The method illustrated within the context of FIG. 1 and FIG. 2 can also be applied similarly to FIG. 3. Further units can be provided between the rolling stock winding device 6' and a finishing train 2 which are used for processing the rolling stock. These are omitted from FIG. 3 in order to improve clarity.

In particular a separation device 7 is present between the rolling stock winding device 6' and the finishing train 2 which is used, in the event of a process deviation of a desired operation, to transfer from continuous operation into discontinuous operation of the plant.

It is also true for this form of embodiment that, if a deviation from planned operation is established, an attempt is first made preferably to transfer the previous outflow product A into a new outflow product A* which is similarly as economically viable as possible and able to be manufactured in continuous operation. If this is not possible, the transition is made from continuous operation of the rolling mill into discontinuous operation and an outflow product which is then required is manufactured.

The separation device 7 allows the rolling stock G to be separated and is thus of great importance for the transition from continuous operation into discontinuous operation of the rolling mill 1. Preferably the separation device 7 is arranged between rolling stock winding device 6' and finishing train 2.

To separate the rolling stock G the separation device 7 is controlled accordingly by the control and/or regulation device 8 configured to carry out the method. The processing speed of the rolling stock G before the separation device 7 is temporarily slowed down by the control and/or regulation device 8 for example, such as the unwinding speed of the rolling stock winding device 6' and the processing speed after the separation device 7 is temporarily increased. The rolling speed of the finishing train 2 arranged in the mass flow direction after the separation device 7 can especially be increased for this purpose.

Moreover the explanations given for FIG. 1 and FIG. 2 can be transferred analogously to FIG. 3. It should be noted in this case that the casting device 6 from FIG. 1 is replaced in FIG. 3 by the rolling stock winding device 6'. Furthermore there is generally no high reduction mill in systems in accordance with FIG. 3, since the temperatures of the rolling stock G reached which would allow a high reduction are generally not reached in rolling mills in accordance with FIG. 3.

What is claimed is:

1. A method for manufacturing rolling stock rolled in a rolling train of a rolling mill, the method comprising:

operating the rolling mill continuously, wherein continuous operation includes feeding a single piece of rolling stock to the rolling mill using a feeding device to conduct a planned operation;

wherein a finishing rolling train continuously receives the rolling stock and continuously ejects a first outflow product, and monitoring the operation of the rolling mill for occurrence of a deviation from the planned operation of the rolling mill, the deviation influencing the rolling process, and upon occurrence of the deviation, checking whether, based at least in part on the deviation, a second outflow product may be manufactured in continuous operation, if the second outflow product may be manufactured in continuous operation, switching production to the second outflow product, and if the second outflow product cannot be manufactured in continuous operation, changing the operation of the rolling mill from continuous operation to discontinuous operation.

2. The method according to claim 1, wherein, if the second outflow product is able to be manufactured, a choice is made as to whether the second outflow product will be manufactured or the operation of the rolling mill is changed to discontinuous operation.

3. The method according to claim 1, wherein a check is made as to whether, in discontinuous operation at least one of the first outflow product and a further second outflow product is able to be manufactured.

4. The method according to claim 1, wherein the change to discontinuous operation is made by separation of the rolling stock between the rolling stock feed device and the finishing rolling train.

5. The method according to claim 4, wherein separation is performed by cutting.

6. The method according to claim 1, wherein, on changing operation into discontinuous operation , at least for a short time, a speed of the rolling stock is reduced by means of the feeding device or at least one of a winding speed of a rolling stock winding device and a rolling speed of the finishing rolling train is increased.

7. The method according to claim 1, wherein, for increasing a distance between the rolling stock entering the finishing rolling train one after the other, the rolling stock is cut at least twice between the feeding device and the finishing rolling train, whereby a part of the rolling stock delimited by the first and the second cut is removed from the rolling process.

8. The method according to claim 1, wherein, if the second outflow product is not able to be manufactured, the operation of the rolling mill is changed from continuous operation of the rolling mill into discontinuous operation during the rolling of rolling stock.

9. The method according to claim 1, wherein the rolling mill is a casting rolling mill.

10. The method according to claim 1, wherein the device is at least one of a casting device and a rolling stock winding device at least up to a finishing rolling train arranged downstream from the feeding device according to a mass flow direction of the rolling stock.

11. The method according to claim 10, wherein the change to discontinuous operation is made by separation of the rolling stock between the casting device or the rolling stock winding device and the finishing rolling train.

12. The method according to claim 10, wherein, on changing operation into discontinuous operation, at least for a short time, a casting speed of the rolling stock is reduced by means of the feeding device at least one of a winding speed of a rolling stock winding device and a rolling speed of the finishing rolling train is increased.

13. The method according to claim 10, wherein, for increasing a distance between the rolling stock entering the finishing rolling train one after the other, the rolling stock is cut at least twice between the casting device or the rolling stock winding device and the finishing rolling train, whereby a part of the rolling stock delimited by the first and the second cut is removed from the rolling process.

* * * * *